United States Patent [19]

Cellier et al.

[11] Patent Number: 4,866,968

[45] Date of Patent: Sep. 19, 1989

[54] HIGH STRENGTH CEMENTED CARBIDE DIES AND MANDRELS FOR A PILGERING MACHINE

[75] Inventors: Francis Cellier, Export; Albert B. Cady, Plum Boro, both of Pa.

[73] Assignee: Westinghouse Electric Corp., Pittsburgh, Pa.

[21] Appl. No.: 63,038

[22] Filed: Jun. 17, 1987

[51] Int. Cl.[4] ..... B21B 21/02; B21B 25/00

[52] U.S. Cl. ..... 72/208; 29/121.1; 29/132; 72/209; 72/214

[58] Field of Search ..... 72/208, 209, 214; 29/132, 130, 121.1, 129.5

[56] References Cited

U.S. PATENT DOCUMENTS

| | | | |
|---|---|---|---|
| 3,842,471 | 10/1974 | Polhall et al. | 29/125 |
| 3,847,763 | 11/1974 | Svensson et al. | 204/148 |
| 3,974,555 | 8/1976 | Strohmeir et al. | 29/132 |
| 4,056,873 | 11/1977 | Cassard et al. | 29/132 |
| 4,090,386 | 5/1978 | Naylor et al. | 72/208 |
| 4,118,964 | 10/1978 | Fusco | 72/208 X |
| 4,137,106 | 1/1979 | Doi et al. | 148/126 |
| 4,233,834 | 11/1980 | Matinlassi | 72/208 |
| 4,466,265 | 8/1984 | Wessel | 72/209 X |
| 4,649,728 | 3/1987 | LaCount et al. | 72/370 X |
| 4,698,884 | 10/1987 | Evans | 29/132 |

*Primary Examiner*—Robert L. Spruill

*Assistant Examiner*—Steven B. Katz

[57] ABSTRACT

Pilger tooling for use in a pilgering machine includes an elongated stationary mandrel for supporting a tube thereon in position for cold reduction, and a pair of roller dies positioned along opposing sides of the mandrel and in oppositely-facing relation to one another for coacting with the mandrel in reducing the cross-sectional size of the tube. Each roller die is ring-shaped with a central opening for mounting the die on a shaft and has a keyway defined therein adjacent the central opening for receiving a key to secure the die for movement with the shaft. The keyway also provides a timing mark for accurately mounting the die on the shaft. Each roller die has two relief pockets formed in the periphery thereof in circumferentially spaced apart relation with a bridge extending therebetween, and a tube-reducing groove formed in the periphery thereof having a tapered configuration and opening at its opposite ends into the respective pockets. The end of one of the relief pockets is disposed radially outwardly from and aligned with the center of the keyway so as to provide a reference point on the die adjacent the periphery thereof. Each of the mandrel and roller dies are fabricated from a high strength cemented carbide material which is composed of tungsten carbide ranging from about 81.5 to about 86 percent by weight and cobalt ranging from about 14 to about 18.5 percent by weight.

18 Claims, 4 Drawing Sheets

HIGH STRENGTH CEMENTED CARBIDE DIES AND MANDRELS FOR A PILGERING MACHINE

BACKGROUND OF THE INVENTION

1. Field of the Invention

The present invention relates to cold pilgering of thin-walled metallic tubing and, more particularly, is concerned with high strength cemented carbide tooling, i.e. dies and mandrels, for use in a pilgering machine.

2. Description of the Prior Art

Cold-pilgering is a conventional process by which a tube is advanced over a stationary mandrel and simultaneously compressed using two opposing roller dies resulting in the reduction of the cross-sectional area and in elongation of the tube. Representative of the prior art pilgering machines are the ones disclosed and illustrated in U.S. Pat. Nos. to Arrington (3,416,346), Edstrom et al (3,487,675 and 3,690,850), Naylor et al (4,090,386) and Matinlassi (4,233,834).

Typically, the input tube is reduced and elongated to the final tube by passing through a succession of stations of the cold-pilgering machine with each station being composed of a stationary mandrel/roller die set. Reduction is effected in both the diameter and wall thickness of the tube by means of the tapered shape of the mandrel and the circumferential tapered shape of grooves in the dies which embrace the tube from above and below the mandrel and roll in a constant cycle back and forth along the tube. Between each cycle of die movement, the tube is advanced and rotated incrementally along the mandrel. The mandrel prevents the tube from collapsing under the force of the roller dies while at the same time dictates the inner diameter of the tube.

Although the mandrels and roller dies are fabricated from high strength steel, a limiting factor in the cold-pilgering process is the need for frequent replacement of mandrels and roller dies. Mandrel replacement is required when the steel mandrels become overstressed and break from the severe operating conditions and the occasional bending moments imposed thereon by tube eccentricity or slight misalignment. Also, the mandrels must be remachined occasionally to remove metal buildup caused by general use. Roller die replacement is frequently required due to occurrence of surface cracks, fretting and spalling in the die grooves of the steel dies as a result of the severe operating conditions of the pilgering machine. The roller dies also must be remachined occasionally to remove metal buildup caused through general use. Typically, a high strength steel roller die will only produce approximately 20,000 feet of tube before the grooves must be remachined.

Consequently, a need exists to increase the longevity of the pilger tooling, i.e., mandrels and roller dies, so as to improve the productivity and efficiency of the pilgering machine.

SUMMARY OF THE INVENTION

The present invention provides high strength cemented carbide pilger tooling, i.e. dies and mandrels, designed to satisfy the aforementioned needs. The mandrels and dies being composed of high strength cemented carbide will provide extended lives over those of mandrels and dies composed of high strength steel. Although the cemented carbide mandrels and dies require more controlled machining in their fabrication, the benefit of extended lifetimes outweights the burden of this additional preparation. The cemented carbide mandrels and dies, because of their larger modulus of elasticity, provide better ovality to the finished tube while at the same time it is believed that the new composition will permit a fifty percent increase in the feed rate of the material through the pilgering mill. Furthermore, if the mandrels do not break during use—a common fate of mandrels heretofore—they may be reground and used more times than mandrels made of high strength steel. Also, it is estimated that the roller dies may be used to roll a minimum of 500,000 feet of tube before remachining is required, as opposed to only 20,000 feet when high strength steel is used.

Accordingly, the present invention is directed to a set of pilger tooling in a cold pilgering machine for cold reducing thin walled tubing which includes an elongated stationary mandrel for supporting a length of tubing thereon in position for cold reduction, and a pair of roller dies positioned along opposing sides of the mandrel and in oppositely-facing relation to one another for coacting with the mandrel in reducing the cross-sectional size of the tubing. Each roller die is ring-shaped with a central opening for mounting the die on a shaft and has a keyway defined therein adjacent the central opening for receiving a key to secure the die for movement with the shaft. The keyway provides a timing mark for accurately mounting the die on the shaft. Each die also has two relief pockets formed in the periphery thereof in circumferentially-spaced apart relation with a bridge extending therebetween, and a tube-reducing groove formed in the periphery thereof having a tapered configuration and opening at its opposite ends into the respective pockets. The end of one of the relief pockets is disposed radially outwardly from and aligned with the center of the keyway so as to provide a reference point on the die adjacent the periphery thereof.

More particularly, each of the mandrel and roller dies are fabricated from a high strength cemented carbide material which is composed of tungsten carbide ranging from about 81.5 to about 86 percent by weight and cobalt ranging from about 14 to about 18.5 percent by weight. The cemented carbide material has a minimum Rockwell Hardness "A" ranging from about 84.6 to about 87.7, a density ranging from about 13.70 to 14.00 grams per cubic centimeter, a minimum transverse rupture strength ranging from about 360,000 to about 420,000 psi, an average grain size ranging from 1–6 micrometers at 1500X Mag., a modulus of elasticity ranging from about 75,000,000 to about 78,000,000 psi, and a compressive strength ranging from about 575,000 to about 600,000 psi.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
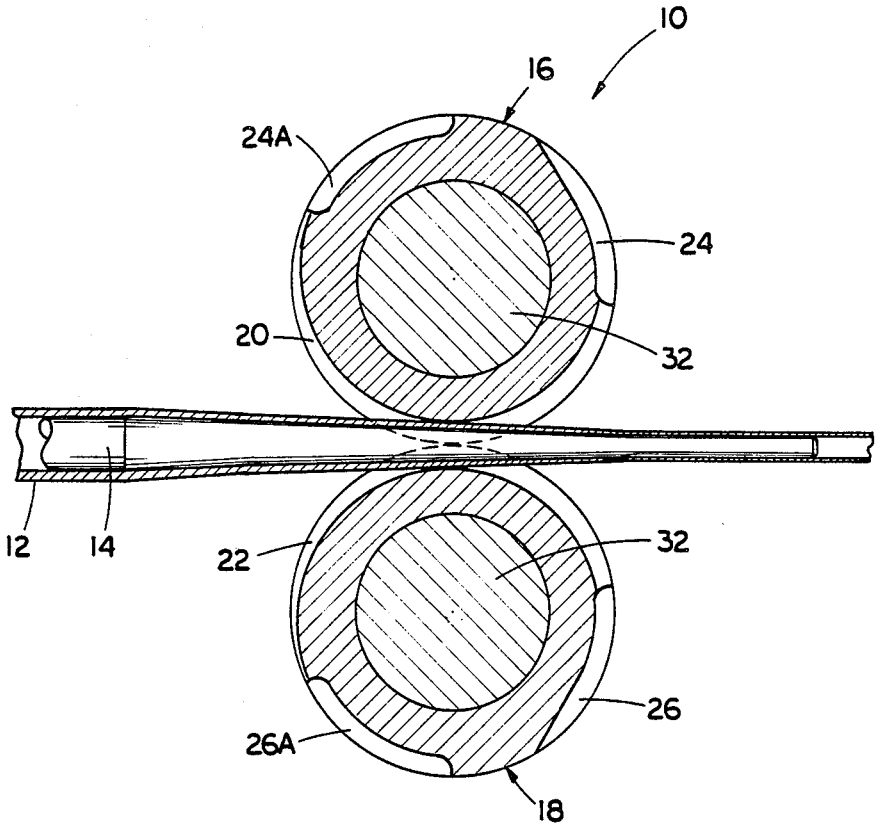
FIG. 1 is a side elevational, schematical view of a set of cemented carbide mandrel and roller dies of the present invention being shown in operative position with respect to a tube being reduced in cross-sectional size and elongated therebetween, the roller dies being shown sectioned along a plane extending perpendicular to their rotational axes.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Referring now to the drawings, and particularly to FIG. 1, there is shown schematically a set of pilger tooling, generally designated 10, constructed in accordance with the principles of the present invention. The tooling 10, useful in a cold pilgering machine for cold reducing thin walled tube 12, includes an elongated stationarily-positioned mandrel 14 for supporting the tube 12 thereon in position for cold reduction, and a pair of upper and lower roller dies 16,18 positioned along opposing sides of the mandrel 14 and in oppositely-facing relation to one another for coacting with the mandrel to reduce the cross-sectional size of the tube 12 in a known manner.

As described earlier, the cold-pilgering process in which the mandrel 14 and dies 16,18 are employed is a conventional cold reducing process in which the tube 12 is advanced over the mandrel 14 as the latter is maintained stationary and simultaneously the tube is compressed using the two opposing roller dies 16,18 resulting in the reduction of the cross-sectional area and in elongation of the tube. Typically, the input tube is reduced and elongated to the final tube by passing through a succession of stations of the cold-pilgering machine with each station being composed of the set of tooling 10. Reduction is effected in both the diameter and wall thickness of the tube 12 by means of the cylindrical tapered shape of the mandrel 14 and the circumferential tapered shape of grooves 20,22 in the dies 16,18 which embrace the tube 12 from above and below the mandrel 14 and roll in a constant cycle back and forth along the tube. Between each cycle of die movement, the tube 12 is advanced and rotated incrementally along the mandrel 14 by suitable conventional mechanism not shown. The mandrel 14 prevents the tube 12 from collapsing under the force of the roller dies 16,18 while at the same time dictates the inner diameter of the tube.

Figure 2:
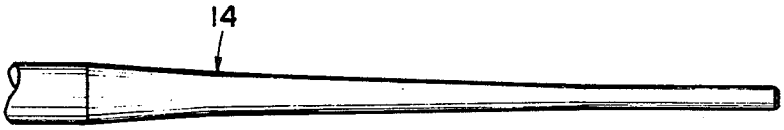
FIG. 2 is an enlarged side elevational view of the mandrel of FIG. 1 by itself.

Unlike the pilger tooling heretofore, the mandrel 14, as shown in FIG. 2, and the roller dies 16,18, one of which is shown in FIGS. 3–7, are fabricated from a high strength cemented carbide material which is composed of tungsten carbide and cobalt. Preferably, the tungsten carbide ranges from about 81.5 to about 86 percent by weight and cobalt from about 14 to about 18.5 percent by weight. Also, the cemented carbide material has a minimum Rockwell Hardness "A" ranging from about 84.6 to about 87.7 and a density ranging from about 13.70 to 14.00 grams per cubic centimeter. In addition, the material has a minimum transverse rupture strength ranging from about 360,000 to about 420,000 psi, an average grain size ranging from 1–6 micrometers at 1500X Mag., a modulus of elasticity ranging from about 75,000,000 to about 78,000,000 psi, and a compressive strength ranging from about 575,000 to about 600,000 psi.

The mandrel 14 is manufactured by any suitable conventional process, such as CNC cylindrical grinding. Each roller die 16,18 is manufactured using a conventional hot isostatic pressing process. The pairs of relief pockets 24,26 are preformed, whereas the grooves 20,22 are machined to their final contour using a conventional electric discharge machining method and/or diamond wheel grinding technique followed by a polishing operation. In the polishing operation, the pockets 24,26, being separated by a bridge structure 28, respectively provide inlets and outlets for the pumping of an abrasive slurry through the grooves. Later in the pilgering operation, the pockets 24,26 provide clearance between the dies 16,18 and the tube 12 at the end of each cycle of die movement which allows the tube to be incrementally advanced and rotated relative to the mandrel 14.

The roller die 16 (as well as die 18 not shown in FIGS. 3–7 but being identical to die 16) is ring-shaped with a central bore or opening 30 for mounting the die on a shaft 32 (FIG. 1) of the pilgering machine. The die 16 also has a keyway 34 defined therein adjacent the central opening 30 for receiving a key (not shown) to secure the die for movement with the shaft. The keyway 34 concurrently provides a timing mark for accurately mounting the die on the shaft. As mentioned earlier, the die 16 has two relief pockets 24 formed in its periphery in circumferentially spaced apart relation with the bridge structure 28 extending therebetween and separating them from one another. Also, the tapered, tube-reducing groove 20 formed in the die periphery opens at its opposite ends into the respective pockets 24.

Figure 3:
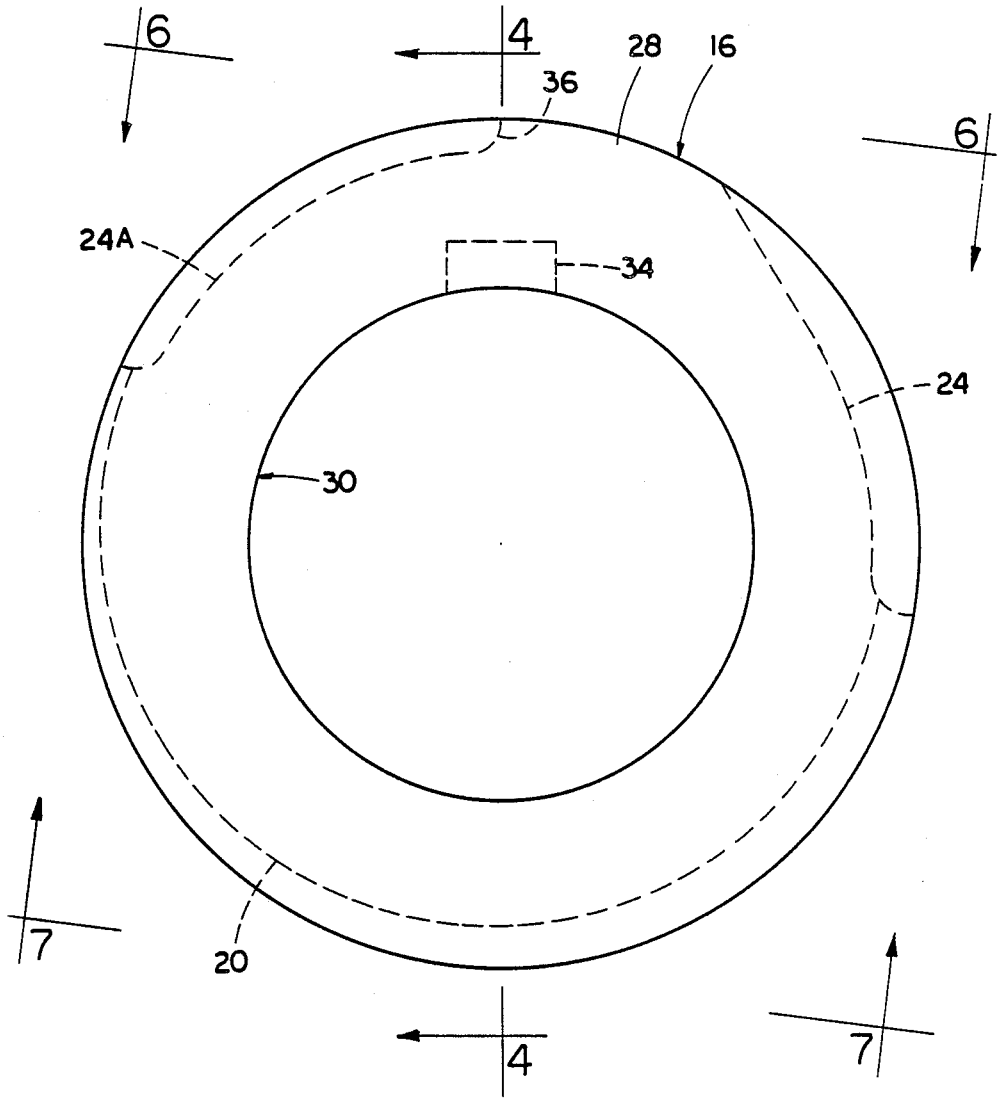
FIG. 3 is an enlarged side elevational view of one of the roller dies of FIG. 1 by itself.
Figure 4:
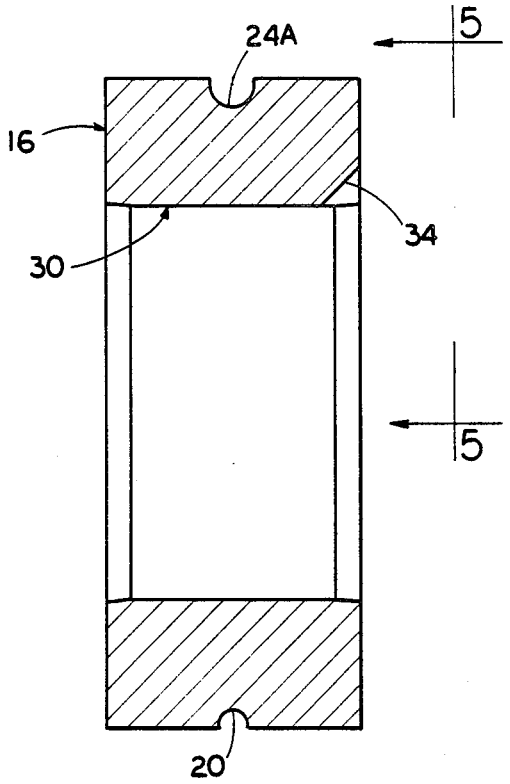
FIG. 4 is a sectional view of the roller die taken along line 4—4 of FIG. 3.
Figure 5:
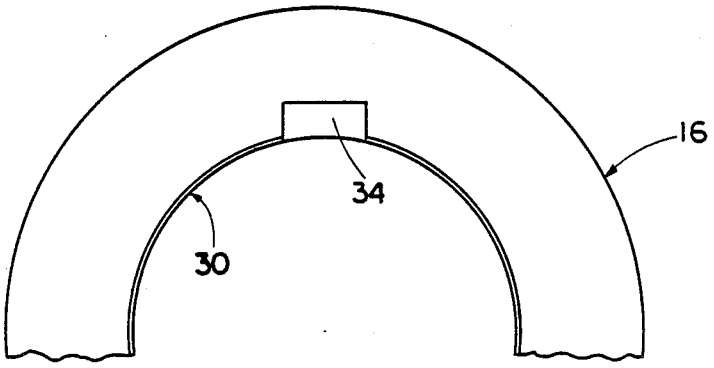
FIG. 5 is a fragmentary side elevational view of the roller die as seen along line 5—5 of FIG. 4, showing a keyway in the die.
Figure 6:
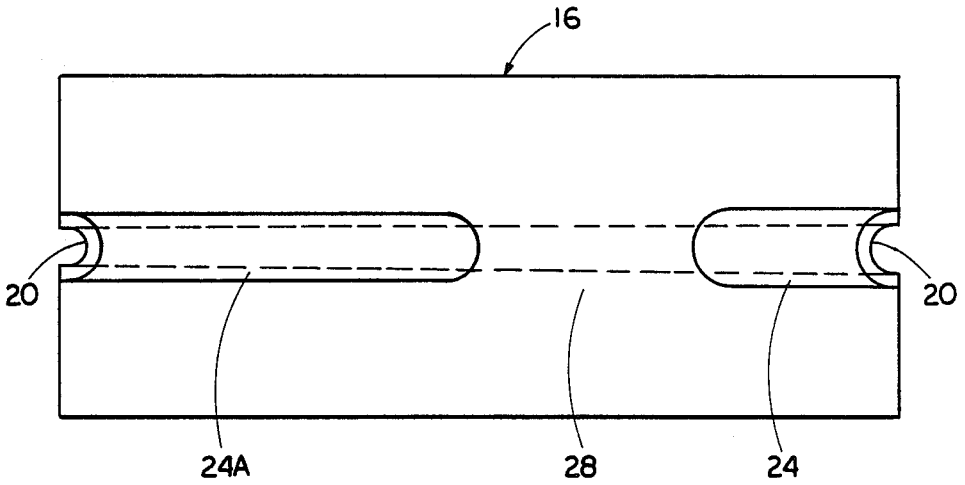
FIG. 6 is an plan view of the roller die as seen along line 6—6 of FIG. 3, showing the two relief pockets formed in the periphery of the roller die and circumferentially-spaced apart with a bridge extending therebetween.
Figure 7:
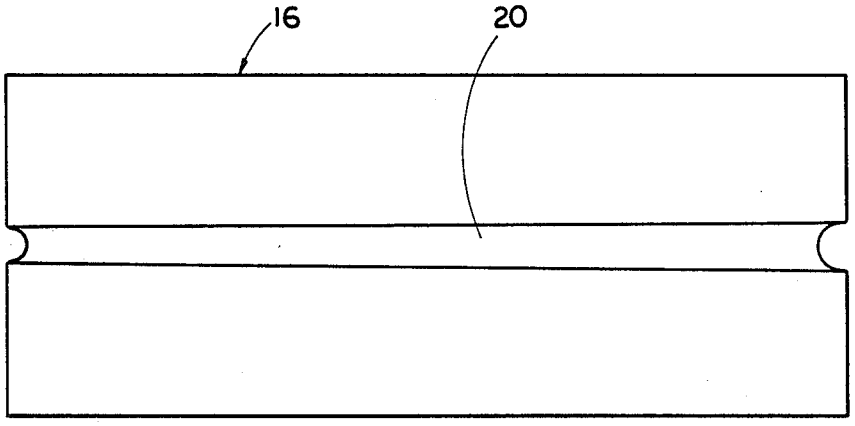
FIG. 7 is another plan view of the roller die as seen along line 7—7 of FIG. 3, showing the tapered configuration of the groove formed in the periphery of the roller die.

When the die 16 is mounted on the pilgering machine shaft 32, its keyway 34 is not visible to the operator for use later in making adjustments. To compensate, as seen in FIG. 3 the end 36 of the one relief pocket 24A is disposed radially outwardly from and aligned with the center of the keyway 34 so as to provide a reference point on the die 16 adjacent the periphery thereof which will be visible to the operator.

It is thought that the cemented carbide pilger tooling of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

We claim:

1. In a cold pilgering machine for cold reducing thin walled tubing, the improvement which comprises:

a pair of roller dies for reducing the cross-sectional size of the tubing, each die being ring-shaped with a central opening for mounting said die on a shaft and having a keyway defined therein adjacent said central opening for receiving a key to secure said die for movement with the shaft, said keyway of said die also providing a timing mark for accurately mounting said die on the shaft, each die having two relief pockets formed in the periphery thereof in circumferentially spaced apart relation with a bridge extending therebetween and a tube-reducing groove formed in the periphery thereof having a tapered configuration and opening at its opposite ends into said respective pockets, an end of one of said pockets being disposed radially outwardly from and aligned with the center of said keyway so as to provide a reference point on said die adjacent the periphery thereof, each die being fabricated from a high strength cemented carbide material.

2. The machine as recited in claim 1, wherein said cemented carbide material is composed of tungsten carbide ranging from about 81.5 to about 86 percent by weight and cobalt ranging from about 14 to about 18.5 percent by weight.

3. The machine as recited in claim 1, wherein said cemented carbide material has a minimum Rockwell Hardness "A" ranging from about 84.6 to about 87.7.

4. The machine as recited in claim 1, wherein said cemented carbide material has a density ranging from about 13.70 to 14.00 grams per cubic centimeter.

5. The machine as recited in claim 1, wherein said cemented carbide material has a minimum transverse rupture strength ranging from about 360,000 to about 420,000 psi.

6. The machine as recited in claim 1, wherein said cemented carbide material has an average grain size ranging from 1–6 micrometers at 1500X Mag.

7. The machine as recited in claim 1, wherein said cemented carbide material has a modulus of elasticity ranging from about 75,000,000 to about 78,000,000 psi.

8. The machine as recited in claim 1, wherein said cemented carbide material has a compressive strength ranging from about 575,000 to about 600,000 psi.

9. In a cold pilgering machine for cold reducing thin walled tubing, the improvement which comprises:

a pair of roller dies for reducing the cross-sectional size of the tubing, each die being ring-shaped with a central opening for mounting said die on a shaft and having a keyway defined therein adjacent said central opening for receiving a key to secure said die for movement with the shaft, said keyway of said die also providing a timing mark for accurately mounting said die on the shaft, each die having two relief pockets formed in the periphery thereof in circumferentially spaced apart relation with a bridge extending therebetween and a tube-reducing groove formed in the periphery thereof having a tapered configuration and opening at its opposite ends into said respective pockets, an end of one of said pockets being disposed radially outwardly from and aligned with the center of said keyway so as to provide a reference point on said die adjacent the periphery thereof, each die being fabricated from a high strength cemented carbide material composed of tungsten carbide ranging from about 1.5 to about 86 percent by weight and cobalt ranging from about 14 to about 18.5 percent by weight, said carbide material having a minimum Rockwell Hardness "A" ranging from about 84.6 to about 87.7, a density ranging from about 13.70 to 14.00 grams per cubic centimeter, a minimum transverse rupture strength ranging from about 360,000 to about 420,000 psi, an average grain size ranging from 1–6 micrometers at 1500X Mag., a modulus of elasticity ranging from about 75,000,000 to about 78,000,000 psi, and a compressive strength ranging from about 575,000 to about 600,000 psi.

10. In a cold pilgering machine for cold reducing thin walled tubing, a set of pilger tooling comprising:

(a) an elongated stationary mandrel for supporting a length of tubing thereon in position for cold reduction, said mandrel being fabricated from a high strength cemented carbide material; and (b) a pair of roller dies positioned along opposing sides of said mandrel and in oppositely-facing relation to one another for coacting with said mandrel in reducing the cross-sectional size of the tubing, each die being ring-shaped with a central opening for mounting said die on a shaft and having a keyway defined therein adjacent said central opening for receiving a key to secure said die for movement with the shaft, said keyway of said die also providing a timing mark for accurately mounting said die on the shaft, each die having two relief pockets formed in the periphery thereof in circumferentially spaced apart relation with a bridge extending therebetween and a tube-reducing groove formed in the periphery thereof having a tapered configuration and opening at its opposite ends into said respective pockets, an end of one of said pockets being disposed radially outwardly from and aligned with the center of said keyway so as to provide a reference point on said die adjacent the periphery thereof, each die being fabricated from a high strength cemented carbide material.

11. The machine as recited in claim 10, wherein said cemented carbide material is composed of tungsten carbide ranging from about 81.5 to about 86 percent by weight and cobalt ranging from about 14 to about 18.5 percent by weight.

12. The machine as recited in claim 10, wherein said cemented carbide material has a minimum Rockwell Hardness "A" ranging from about 84.6 to about 87.7.

13. The machine as recited in claim 10, wherein said cemented carbide material has a density ranging from about 13.70 to 14.00 grams per cubic centimeter.

14. The machine as recited in claim 10, wherein said cemented carbide material has a minimum transverse rupture strength ranging from about 360,000 to about 420,000 psi.

15. The machine as recited in claim 10, wherein said cemented carbide material has an average grain size ranging from 1–6 micrometers at 1500X Mag.

16. The machine as recited in claim 10, wherein said cemented carbide material has a modulus of elasticity ranging from about 75,000,000 to about 78,000,000 psi.

17. The machine as recited in claim 10, wherein said cemented carbide material has a compressive strength ranging from about 575,000 to about 600,000 psi.

18. The machine as recited in claim 10, wherein said cemented carbide material is composed of tungsten carbide ranging from about 81.5 to about 86 percent by weight and cobalt ranging from about 14 to about 18.5 percent by weight and has a minimum Rockwell Hardness "A" ranging from about 84.6 to about 87.7, a density ranging from about 13.70 to 14.00 grams per cubic centimeter, a minimum transverse rupture strength ranging from about 360,000 to about 420,000 psi, an average grain size ranging from 1–6 micrometers at 1500X Mag., a modulus of elasticity ranging from about 75,000,000 to about 78,000,000 psi, and a compressive strength ranging from about 575,000 to about 600,000 psi.

* * * * *